US006533602B2

(12) United States Patent
Nankou

(10) Patent No.: US 6,533,602 B2
(45) Date of Patent: Mar. 18, 2003

(54) DIVIDED CONNECTOR

(75) Inventor: Yuuichi Nankou, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 10/020,950

(22) Filed: Dec. 19, 2001

(65) Prior Publication Data

US 2002/0081889 A1 Jun. 27, 2002

(30) Foreign Application Priority Data

Dec. 25, 2000 (JP) ..... 2000-393426

(51) Int. Cl.[7] ..... H01R 13/627

(52) U.S. Cl. ..... 439/352; 439/695; 439/686; 439/598

(58) Field of Search ..... 439/352, 701, 439/715, 716, 717, 353, 354, 355, 695, 686, 712, 713, 724, 598, 599, 594, 597, 595

(56) References Cited

U.S. PATENT DOCUMENTS 5,122,077 A * 6/1992 Maejima et al. ..... 439/398
5,320,564 A * 6/1994 Anderson ..... 439/716
5,683,272 A * 11/1997 Abe et al. ..... 439/747

FOREIGN PATENT DOCUMENTS

JP 5-94967 12/1993

* cited by examiner

*Primary Examiner*—P. Austin Bradley
*Assistant Examiner*—Ross Gushi
(74) *Attorney, Agent, or Firm*—Banner & Witcoff, Ltd.

(57) ABSTRACT

The invention provides a divided connector wherein the engaging force of a lock is not weakened when a sub connector housing and a frame are separated by a jig. Locking members 13 are formed in a cantilevered shape. Free ends 13B thereof engage with engaging edges 14A of lock receiving members 14, thereby maintaining a sub connector housing 4 and a frame 5 in an unremovable state. A guiding groove 21 is formed, in an anterior-posterior direction, at the centre of each lock receiving member 14, and a portion of each free end 13B corresponding to the guiding groove 21 forms a jig contacting region 25. An engaging region 24 is formed to the left and right of each jig contacting region 25, these engaging regions 24 engaging with the engaging edges 14A. Since a lock releasing jig 26 makes contact with the jig contacting region 25, this lock releasing jig 26 does not damage the engaging regions 24.

8 Claims, 7 Drawing Sheets

DIVIDED CONNECTOR

TECHNICAL FIELD

The present invention relates to a divided electrical connector.

BACKGROUND TO THE INVENTION

FIG. 10 of this specification shows a divided connector described in JP 5-94967. This divided connector is provided with: a sub connector housing 101 capable of housing male terminal fittings 100; and a frame 102 which houses the sub connector housing 101. Locking members 103 and lock receiving members 106, these mutually engaging to lock the sub connector housing 101 and the frame 102 together, are formed on the sub connector housing 101 and the frame 102. The locking members 103 protrude as a pair from upper and lower sides of outer wall faces 101A of the sub connector housing 101. Grooves 105 are formed in inner wall faces 102A of the frame 102 at locations corresponding to the locking members 103. Innermost ends of the grooves 105 extend as far as the inner wall faces 102A, and are perpendicular thereto. These innermost ends form the lock receiving members 106.

After the sub connector housing 101 and the frame 102 have been joined together, they may need to be separated for maintenance or the like. In that case, a releasing jig, such as a miniature screwdriver, is inserted from the opening direction of the grooves 105 (the direction of the arrow A in FIG. 10) and a tip of the jig is inserted between the locking members 103 and the lock receiving members. The tip of the jig moves the inner wall faces 102A and the outer wall faces 101A in a direction of mutual separation, releasing the lock.

When the releasing jig performs the releasing operation, the lock receiving member 106 is sometimes scraped by the tip of the releasing jig, causing this lock receiving member 106 to be damaged. This weakens the engaging force between the locking members 103 and the lock receiving members 106.

The present invention has taken the above problem into consideration, and aims to present a divided connector wherein the engaging force of the lock is not weakened when the sub connector housing and the frame are separated by the jig.

SUMMARY OF THE INVENTION

According to the invention there is provided a connector comprising a sub connector body adapted to receive terminal fittings of electric wires, and a peripheral frame for the sub connector body, said body and frame having a latch comprising a resilient arm on one of said body and frame, and an abutment on the other of said body and frame, said abutment being engageable with said arm to maintain said body and frame in a predetermined relative position; characterized in that said latch is releasable by engagement of a tool with a first region thereof, a second region of said latch comprising engagement surfaces of said arm and abutment.

Preferably the second region extends on either side of the first region, and in a preferred embodiment these regions are co-planar. The regions are preferably provided on the resilient arm. In the preferred embodiment a guide channel is provided for the latch releasing tool, preferably in said abutment, and preferably in the form of a groove.

BRIEF DESCRIPTION OF DRAWINGS

Other features of the invention will be apparent from the following description of a preferred embodiment shown by way of example only in the accompanying drawings, in which.

DESCRIPTION OF PREFERRED EMBODIMENT

An embodiment of the present invention is described below with the aid of FIGS. 1 to 9.

Figure 1:
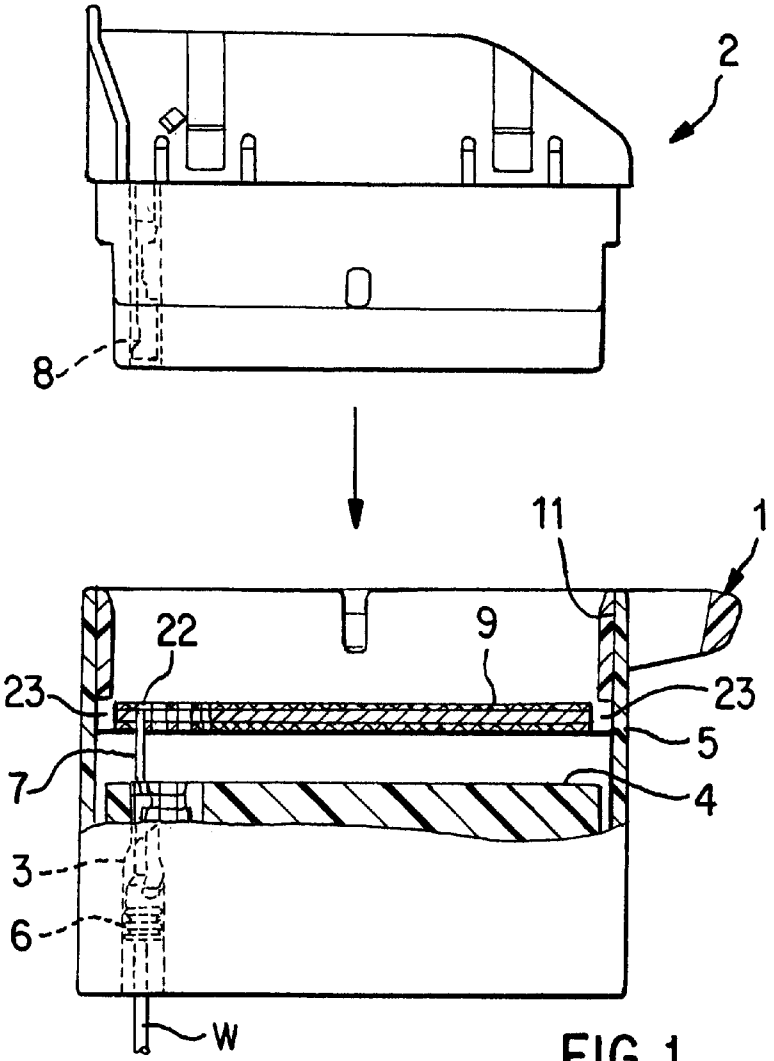
FIG. 1 is a plan view showing a divided connector and a corresponding connector of the present embodiment prior to their being fitted together (a portion of the divided connector is shown cross-sectionally).

FIG. 1 shows a divided connector 1 and a corresponding connector 2 of the present embodiment in a state prior to their being fitted together. The corresponding connector 2 is a female connector which houses female terminal fittings 8. The divided connector 1 is a male connector capable of housing male terminal fittings 3. The two connectors 1 and 2 are capable of fitting mutually together, this fitting together causing the male terminal fittings 3 and the female terminal fittings 8, which are housed within the connectors 1 and 2 respectively, to be joined together. In the following description of the components of the divided connector 1, unless specifically stated otherwise, the anterior side refers to the side towards the fitting direction of the divided connector 1 and the corresponding connector 2.

The divided connector 1 is broadly divided into: a sub connector housing 4 capable of housing the male terminal fittings 3; a frame 5 capable of housing the sub connector housing 4; and a moving plate 9 provided within the frame 5 at an anterior face side of the sub connector housing 4.

The male terminal fittings 3 are joined with ends of electric wires W, each joining portion thereof being provided with a resilient water-proofing member 6. The electric wires W extend towards the posterior of the divided connector 1 (that is, the direction of extension of the electric wires of the present invention is a posterior direction in the present embodiment). Further, joining protrusions 7, these being capable of joining with the female terminal fittings 8, are formed at anterior ends of the male terminal fittings 3.

The moving plate 9, which is attached to the frame 5, has terminal through holes 22 formed therein at locations which correspond to the joining protrusions 7 of the male terminal fittings 3. The moving plate 9 is attached from an attaching opening 11 at the anterior of the frame 5 and is joined at a specified location to the anterior of the sub connector housing 4. The moving plate 9 is capable of moving in an anterior-posterior direction (i.e., in the fitting direction of the two connectors 1 and 2). When the divided connector 1 is in a single state, whereby it is not yet fitted with the corresponding connector 2, tips of the joining protrusions 7 are located within the terminal through holes 22 of the moving plate 9 (see FIG. 1), this preventing the joining protrusions 7 from moving or being damaged.

When the two connectors 1 and 2 are fitted together, the moving plate 9 is pressed by an anterior face of the corresponding connector 2 and moves towards the posterior while the joining protrusions 7 protrude from an anterior face of the moving plate 9, these joining protrusions 7 entering a state whereby they can join with the female terminal fittings 8. Moreover, jig insertion holes 23, via which a lock releasing jig 26 can be inserted, are provided in the moving plate 9 at locations to the anterior of locking members 13 of the frame 5.

Figure 2:
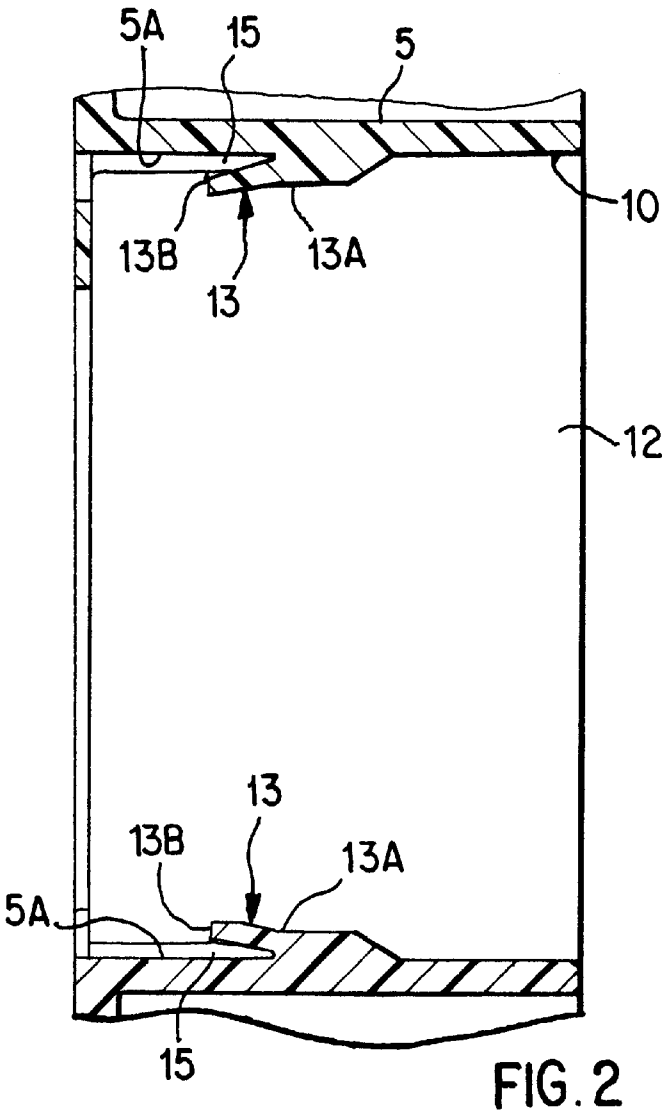
FIG. 2 is a plan cross-sectional view showing a frame from a centre thereof to a posterior end portion thereof.
Figure 5:
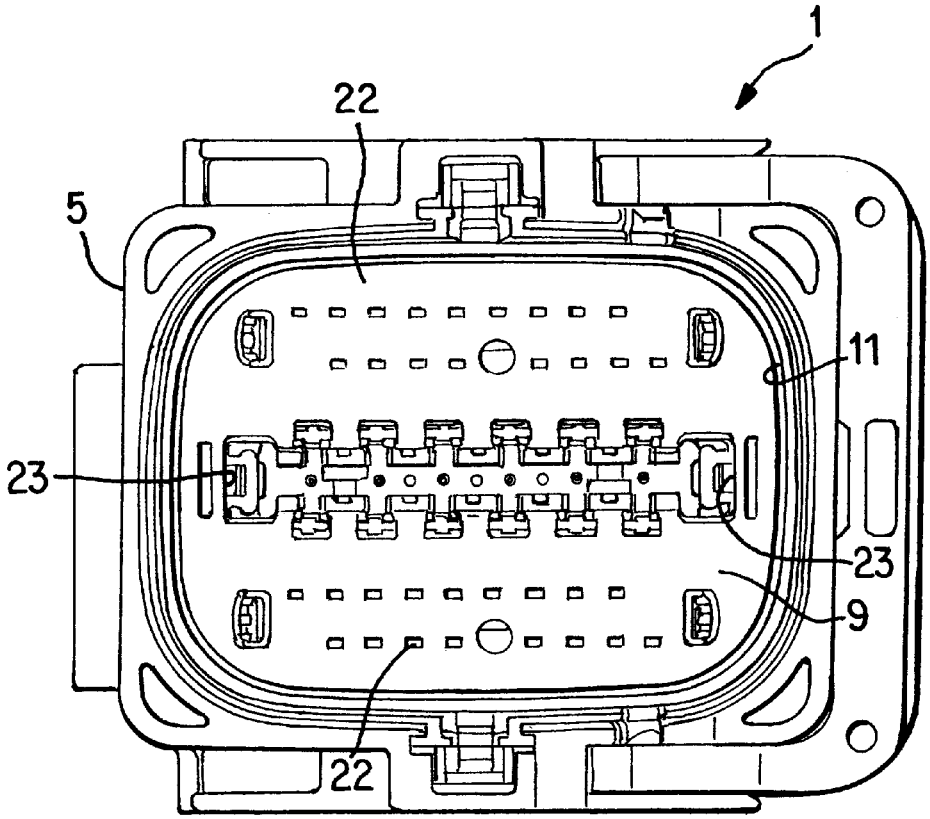
FIG. 5 is a front view of the divided connector.
Figure 6:
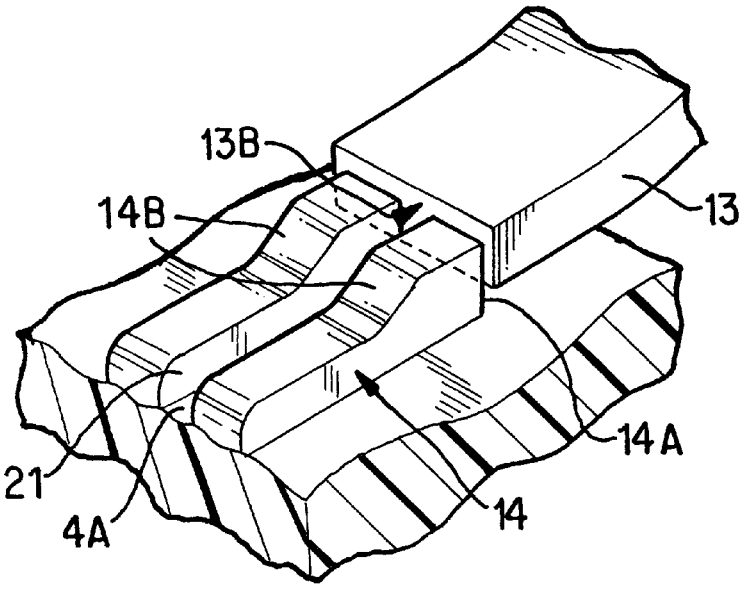
FIG. 6 is an expanded diagonal view of a locking member and a lock receiving member in an engaged state.

As shown in FIG. 2, the frame 5 has a cylindrical shape that is open at the anterior and the posterior. The corresponding connector 2 is inserted therein from the anteriorly-located attaching opening 11, this being one of two openings 10 and 11. (FIG. 2 shows only the portion of the frame 5 that houses the sub connector housing 4; the attaching opening 11 is shown in FIGS. 1 and 5). The sub connector housing 4 is fitted into the frame 5 from a posteriorly-located fitting opening 10. A housing receiving space 12 extends from a posterior end (the fitting opening 10) of the frame 5 to the centre of the frame 5, the sub connector housing 4 being housed therein. The pair of resilient arms or locking members 13 protrude into this housing receiving space 12 from left and right sides thereof (upper and lower sides thereof relative to FIG. 2). Each locking member 13 has a fixed end 13A at its posterior, this being fixed to an inner wall face 5A of the frame 5, and a free end 13B at its anterior, this protruding in an inclined manner towards the centre of the anterior of the housing receiving space 12.

The free ends 13B of the locking members 13 are capable of bending resiliently in the left-right direction of the frame 5 (i.e., perpendicular to the anterior-posterior direction in which the sub connector housing 4 is fitted within the frame 5). Furthermore, spaces 15 (spaces formed between the locking members 13 and the inner wall faces 5A from which these locking member 13 protrude) are open in the direction of the anteriorly-located attaching hole 11. The locking members 13 can bend resiliently into these spaces 15. Moreover, as will be described, the free ends 13B are capable of engaging with abutments or lock receiving members 14 of the sub connector housing 4, such that locking members 13 and lock receiving members 14 form a latch. As will later be described in detail, the free ends 13B are divided into engagement surfaces or engaging members 24, which engage with the lock receiving members 14, and a jig contacting member 25, which makes contact with the lock releasing jig 26 and forms a first region of the latch.

Figure 3:
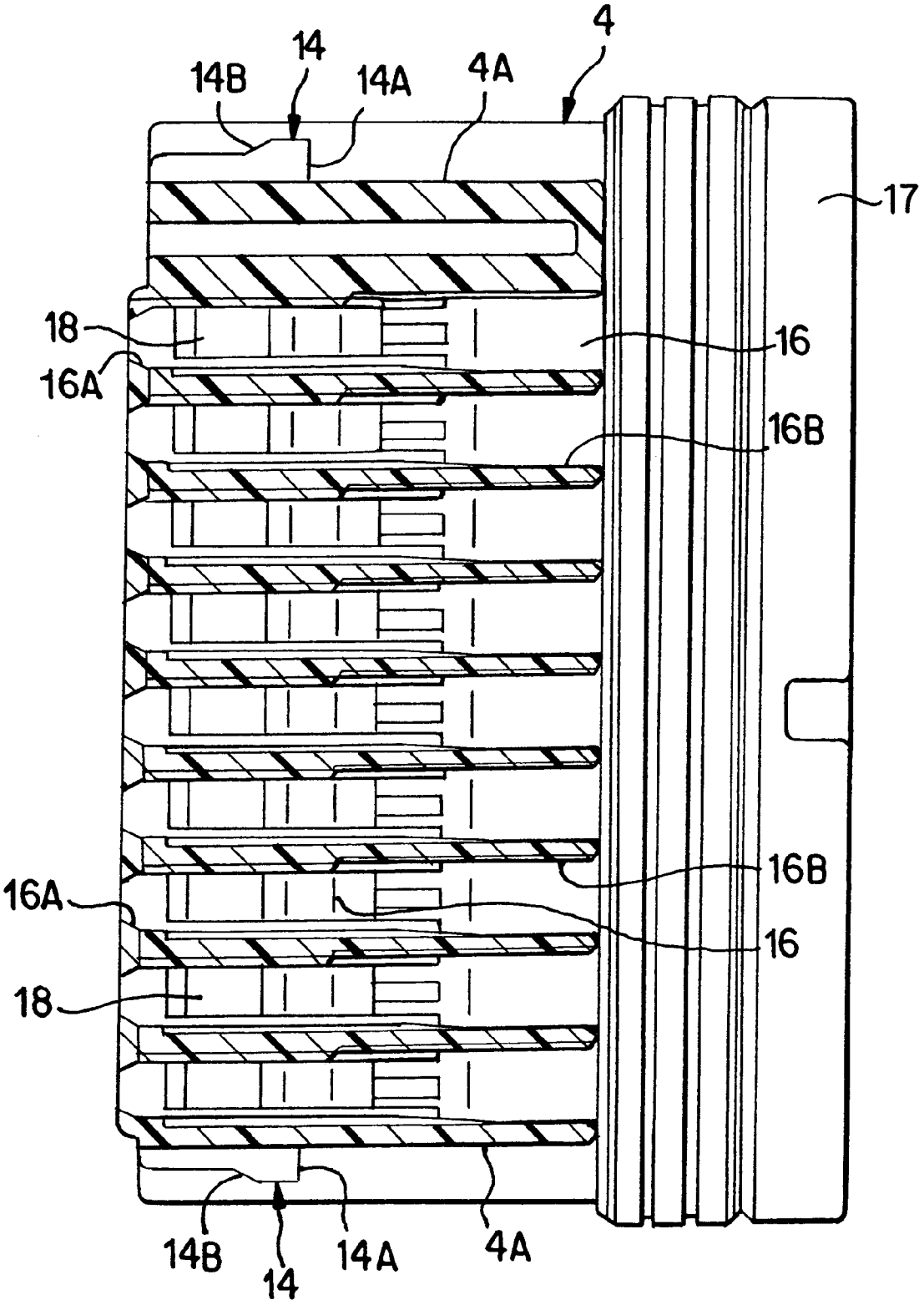
FIG. 3 is a plan cross-sectional view of a sub connector housing.
Figure 4:
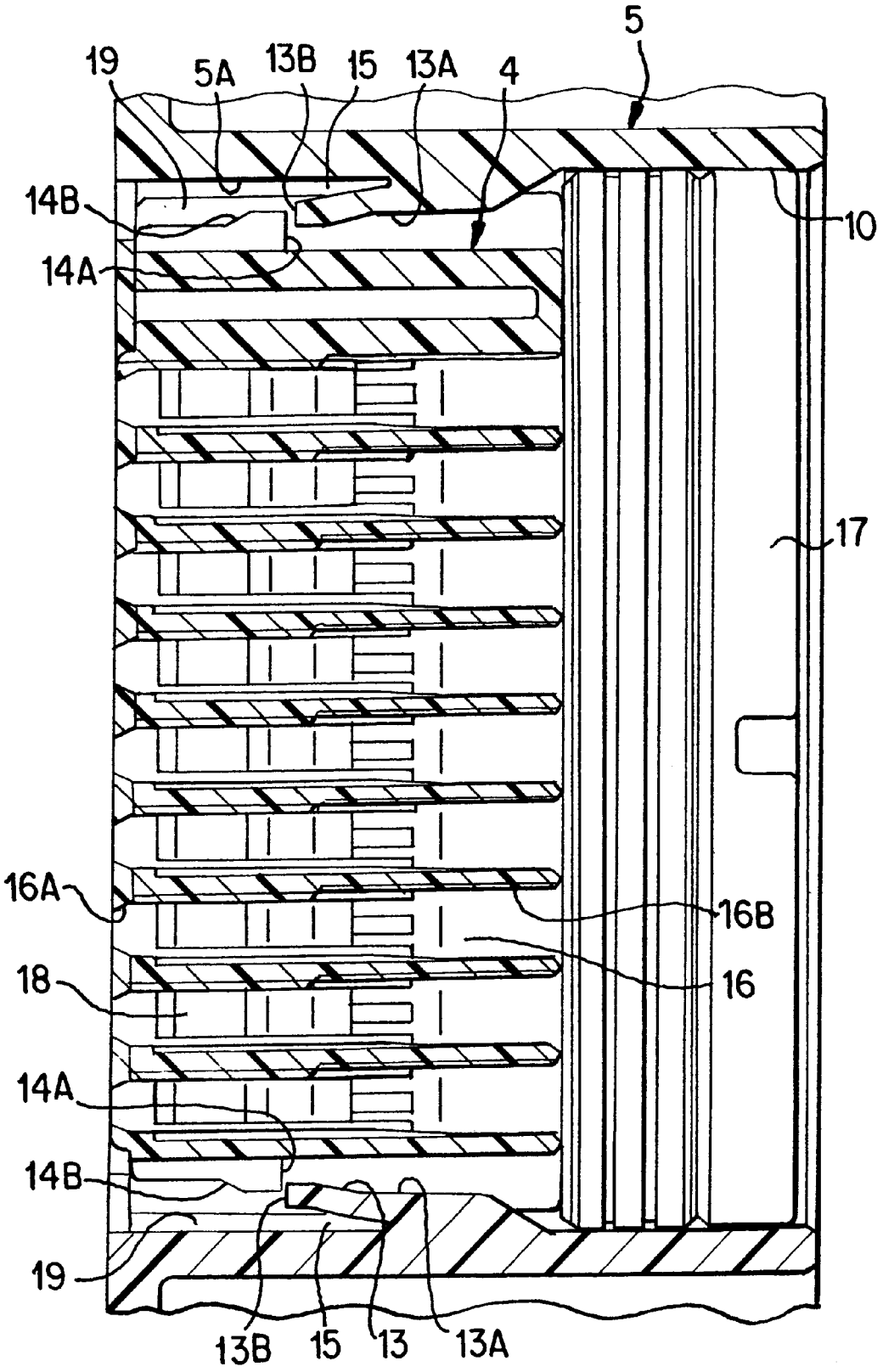
FIG. 4 is a plan cross-sectional view showing the sub connector housing and the frame in a correct joining position.

As shown in FIG. 3, the sub connector housing 4 is formed such that it can be inserted into the housing receiving space 12. Terminal housing chambers 16 for housing the male terminal fittings 3 are formed within the sub connector housing 4. These terminal housing chambers 16 are open to the anterior and the posterior, the anterior openings being small and forming protrusion insertion holes 16A into which the joining protrusions 7 can protrude. The posterior openings are large and form terminal attachment holes 16B via which the male terminal fittings 3 are attached. Lances 18, which bend resiliently and are capable of engaging with the male terminal fittings 3, are formed within the terminal housing chambers 16. Moreover, a resilient ring-shaped water-proofing member 17 is attached to a posterior end portion of the sub connector housing 4. An outer circumference edge of this water-proofing member 17 fits tightly with a hole edge of the fitting opening 10 of the frame 5, thereby achieving a water-proof configuration.

The lock receiving members 14 protrude from left and right side wall faces 4A of the sub connector housing 4. Anterior ends of the lock receiving members 14 form guiding faces 14B which are inclined towards the posterior. When the sub connector housing 4 and the frame 5 are joined, the free ends 13B of the locking members 13 are pushed outwards, this causing them to bend resiliently in the direction of the spaces 15. Posterior face ends of the lock receiving members 14 form engagement surfaces or engaging edges 14A that protrude in an approximately perpendicular manner relative to the side wall faces 4A (more accurately, these engaging edges 14A are inclined slightly towards the posterior). Engaging edges 14A and engaging members 24 form a second region of the latch. Furthermore, a channel or guiding groove 21, which extends in an anterior-posterior direction, is formed in a centre of each lock receiving member 14 (see FIG. 6). These guiding grooves 21 are provided at the side from which the lock releasing jig 26 is inserted, this lock releasing jig 26 releasing the engaged state of the locking members 13 and the lock receiving members 14.

The engaging edges 14A are formed as an upper and lower pair. The portions of the free ends 13B of the locking members 13 which engage with the engaging edges 14A (i.e., the portions which face, from the sides, towards the centre) form the engaging members 24. The engaging members 24 and the jig contacting member 25 are shown only in FIG. 9. Moreover, the free ends 13B are actually formed as a unified face. However, FIG. 9 differentiates between the engaging members 24 and the jig contacting member 25 in order to easily distinguish them. The portion of each free end 13B which corresponds to the guiding groove 21, and which differs in location from the engaging members 24, forms the jig contacting member 25. That is, the jig contacting member 25 is formed at the inner side of each locking member 13, relative to the widthwise direction thereof.

After the sub connector housing 4 and the frame 5 have been joined in a correct joining position, a space of specified dimensions is formed between the lock receiving members 14 and anterior ends of the locking members 13. These spaces form inserting routes 19 that are open towards the anterior face of the frame 5 (see FIG. 4). The lock releasing jig 26 can be inserted along these inserting routes 19.

Figure 8:
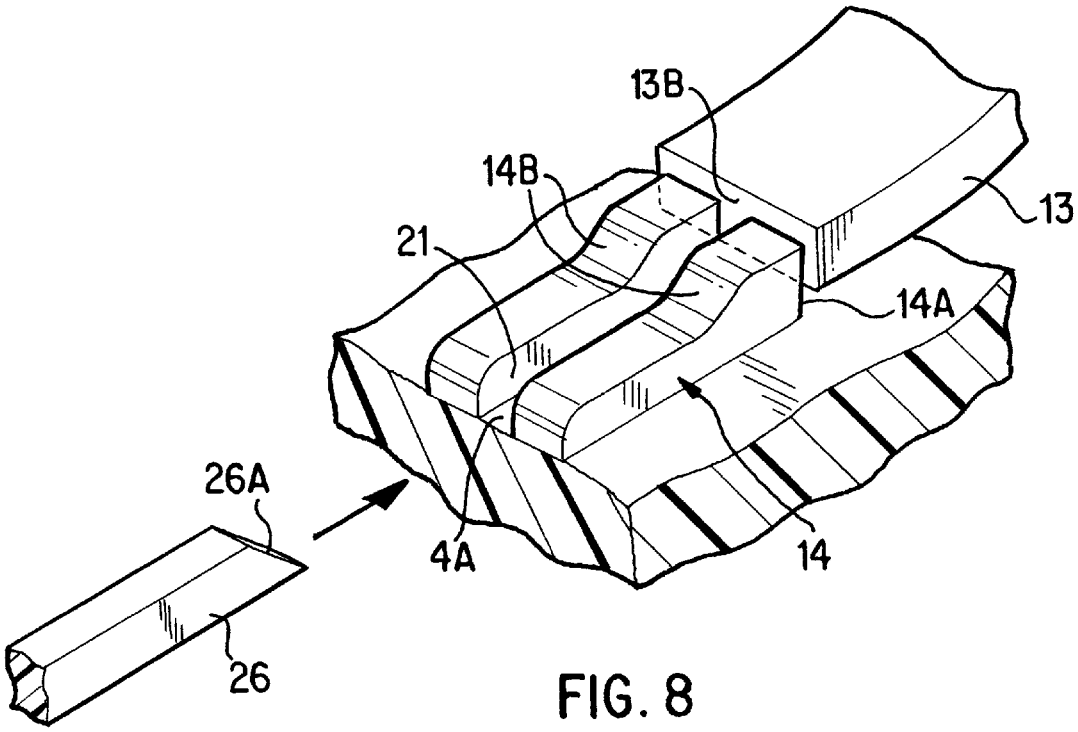
FIG. 8 is an expanded diagonal view (1) showing the locking member and the lock receiving member being released from their engaged state by the lock releasing jig.

As shown in FIG. 8, the lock releasing jig 26 is pole-like with a tapering tip. The tip portion thereof can be inserted between the fitting portions of the locking members 13 and the lock receiving members 14. Performing the releasing operation causes the free ends 13B of the locking members 13 to bend resiliently towards the inner wall faces 5A, this releasing the engaged state of the locking members 13 and the lock receiving members 14.

Next, the operation and effects of the present embodiment, configured as described above, are described with the aid of FIGS. 4 to 9.

When the divided connector 1 is to be joined, the male terminal fittings 3, which are joined to the ends of the electric wires W, are first housed within the terminal housing chambers 16 of the sub connector housing 4. The male terminal fittings 3 are pushed in to a correct position, then the lances 18 resiliently engage with these male terminal fittings 3, thereby preventing their removal.

Next, the sub connector housing 4 is attached within the housing receiving space 12 of the frame 5, this joining the divided connector 1. When the frame 5 and the sub connector housing 4 are fitted together such that they reach a correct joining position, the locking members 13 and the lock receiving members 14 engage, this maintaining the sub connector housing 4 and the frame 5 in a joined state (see FIGS. 4 and 5). More accurately, the engaging edges 14A, which are formed as a pair at the posterior face of each lock receiving member 14, are engaged with the engaging members 24, these being formed as a pair at the free ends 13B of the locking members 13 (see FIG. 6). At this juncture, the jig contacting members 25 of the free ends 1 3B are located in a position whereby they can be seen from the anterior via the guiding grooves 21 of the locking receiving members 14.

Figure 7:
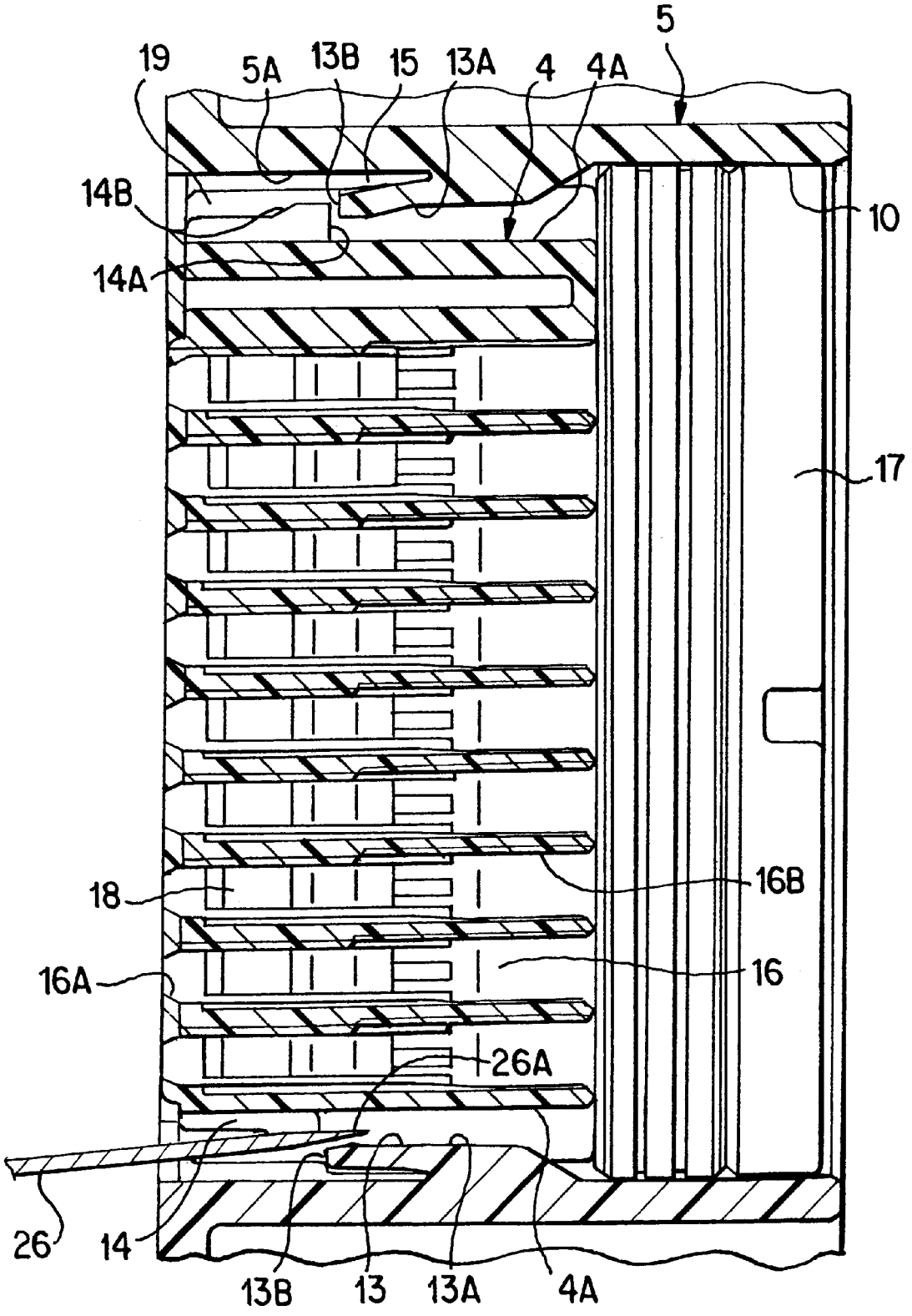
FIG. 7 is a plan cross-sectional view showing the locking member and the lock receiving member being released from their engaged state by a lock releasing jig.

However, the engaged state of the locking members 13 and the lock receiving members 14 may need to be released, and the sub connector housing 4 and the frame 5 separated, so that maintenance, or the like, can be performed on the divided connector 1. In that case, as shown in FIG. 7, the lock releasing jig 26 is inserted from the anterior face side of the divided connector 1 (from the side with the attaching hole 11). This lock releasing jig 26 causes the free ends 13B of the locking members 13 to bend resiliently, releasing the engaged state of the locking members 13 and the lock receiving members 14.

As shown in FIG. 8, the engaged state of the locking members 13 and the lock receiving members 14 is released as follows: a tip end 26A of the lock releasing jig 26 approaches the locking member 13 from the lock receiving member 14. At this juncture, even if the position of the tip end 26A is misaligned, the guiding groove 21 guides the tip end 26A to the jig contacting member 25. Consequently, the insertion process can be performed smoothly.

Figure 9:
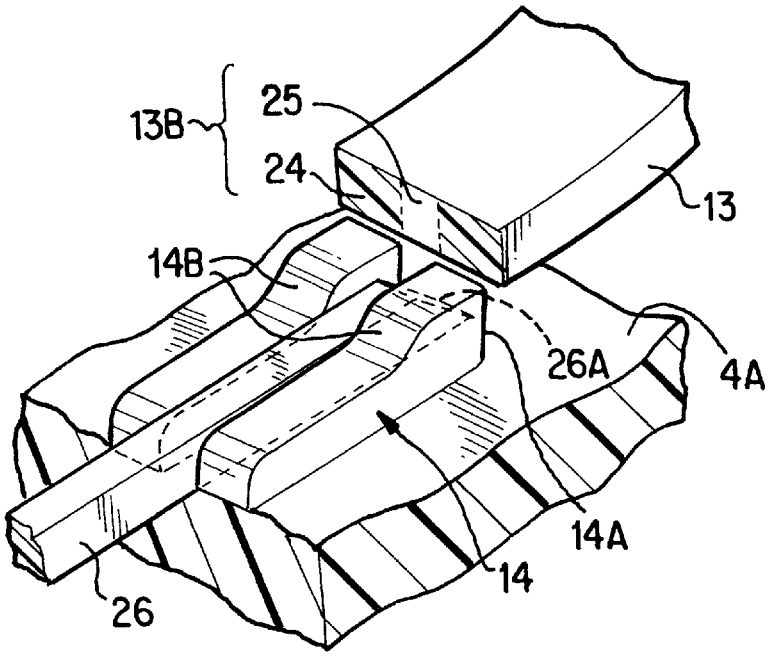
FIG. 9 is an expanded diagonal view (2) showing the locking member and the lock receiving member being released from their engaged state by the lock releasing jig.
Figure 10:
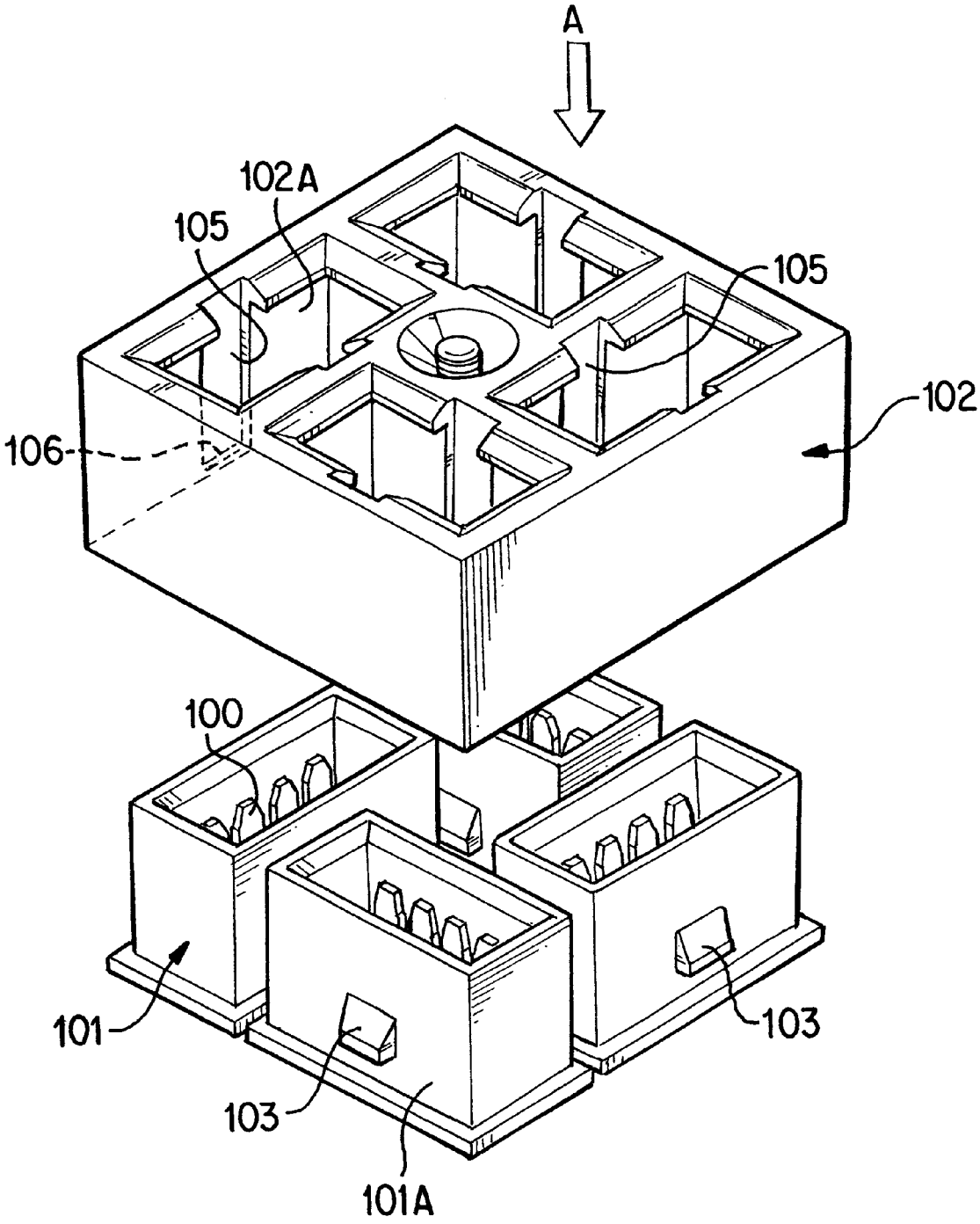
FIG. 10 PRIOR ART
FIG. 10 is a diagonal view of a prior art divided connector prior to the joining of a frame and a sub connector housing.

As shown in FIG. 9, after the tip end 26A of the lock releasing jig 26 makes contact with the jig contacting member 25, this tip end 26A is inserted further inwards at the posterior of the free end 13B (that is, the tip end 26A is inserted between the free end 13B and the side wall face 4A), and the free end 13B bends resiliently towards the inner wall face 5A of the frame 5, thus performing the releasing operation. Then the free ends 13B return resiliently to their original position, and the engaged state of the locking members 13 and the lock receiving members 14 is released.

In the present embodiment, the engaged state of the locking members 13 and the lock receiving members 14 can be released, and the sub connector housing 4 and the frame 5 thereby separated, by causing the lock releasing jig 26 to make contact with the jig contacting member 25 alone. The engaging members 24, which effect the engagement, and the jig contacting member 25, which makes contact with the lock releasing jig 26, are formed separately. Consequently, the tip end 26A of the lock releasing jig 26 does not scrape the engaging members 24 when the releasing operation is performed, and the engaging force is not adversely affected. Furthermore, when the lock releasing jig 26 is inserted so as to release the engaged state of the locking member 13 and the lock receiving member 14, the guiding groove 21 guides the tip end 26A of the lock releasing jig 26 to the jig contacting member 25. Consequently, the releasing operation can be performed smoothly.

In the present embodiment, the direction of extension of the electric wires W (towards the posterior) differs from the direction of insertion of the lock releasing jig 26 (from the anterior). As a result, the electric wires W do not interfere when the engaged state of the sub connector housing 4 and the frame 5 is to be released, and the operation can be performed smoothly.

Further, in the present embodiment, the locking members 13 have a cantilevered shape, being provided with the fixed ends 13A and the free ends 13B, the lock receiving members 14 engaging therewith at the side with the free ends 13B, and these resiliently bendable locking members 13 being provided with the jig contacting members 25. Consequently, when the lock is to be released, the force of the lock releasing jig 26 is exerted directly on the locking member 13. As a result, the releasing operation can be performed easily compared to the case whereby a jig contacting member is provided on a locking member which is not capable of bending resiliently.

The present invention is not limited to the embodiment described above, but may be embodied in various other ways without deviating from the scope thereof. In addition, the technical range of the present invention also encompasses possibilities of equivalent technical range.

What is claimed is:

1. A connector comprising a sub connector body adapted to receive terminal fittings of electric wires, and a peripheral frame for the sub connector body, said body and frame having a latch comprising a resilient arm and an abutment, the resilient arm being on one of said body and frame and the abutment being on the other of said body and frame, said abutment being engageable with said arm to maintain said body and frame in a predetermined relative position; wherein said latch is releasable by engagement of a tool with a first region thereof, a second region of said latch comprising engagement surfaces of said arm and abutment, a guide channel to guide the tool to the first region extending between the engagement surfaces of the abutment.

2. A connector according to claim 1 wherein said second region extends on either side of said first region.

3. A connector according to claim 1 wherein said latch is releasable by engagement of a tool with said arm.

4. A connector according to claim 1 wherein said arm is on the frame and said abutment is on the sub connector body.

5. A connector according to claim 1 wherein a latch is provided on opposite sides thereof.

6. A connector according to claim 1, wherein the engagement surfaces of the abutment are inclined toward a posterior of the connector.

7. A connector according to claim 1 wherein said sub connector body defines an entrance direction for terminal fittings of electric wires, said tool being insertable into said connector from a different direction.

8. A connector according to claim 7 wherein the insertion direction of said tool is opposite to said entrance direction.

* * * * *